US012781404B2

(12) United States Patent
Matsushima

(10) Patent No.: US 12,781,404 B2
(45) Date of Patent: Nov. 3, 2026

(54) NON-TRANSITORY COMPUTER-READABLE MEDIUM AND SEWING MACHINE

(71) Applicant: BROTHER KOGYO KABUSHIKI KAISHA, Nagoya (JP)

(72) Inventor: Mika Matsushima, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 163 days.

(21) Appl. No.: 18/588,450

(22) Filed: Feb. 27, 2024

(65) Prior Publication Data

US 2024/0287718 A1 Aug. 29, 2024

(30) Foreign Application Priority Data

Feb. 28, 2023 (JP) ..... 2023-029770

(51) Int. Cl.
*D05B 19/10* (2006.01)
*D05B 19/12* (2006.01)

(52) U.S. Cl.
CPC ..... *D05B 19/10* (2013.01); *D05B 19/12* (2013.01)

(58) Field of Classification Search
None
See application file for complete search history.

(56) References Cited

U.S. PATENT DOCUMENTS 6,937,919 B1 * 8/2005 Muto ..... D05B 19/08 700/138
7,493,867 B2 * 2/2009 Asano ..... D05B 19/085 700/138
8,655,474 B2 * 2/2014 Katano ..... D05B 19/08 700/138
8,746,161 B2 * 6/2014 Tashiro ..... D05B 19/16 112/470.03
9,441,319 B2 * 9/2016 Ihira ..... D05B 19/12
10,167,584 B2 * 1/2019 Tashiro ..... D05C 7/04
10,702,365 B2 * 7/2020 Jones ..... A61F 2/0063
11,180,879 B2 * 11/2021 Yamanashi ..... D05B 19/006
2011/0288568 A1 * 11/2011 Capuzziello ..... A61F 2/0063 606/151

FOREIGN PATENT DOCUMENTS

JP S62112583 A * 5/1987
JP 2000-107476 A 4/2000

* cited by examiner

*Primary Examiner* — Grace Huang
(74) *Attorney, Agent, or Firm* — Oliff PLC

(57) ABSTRACT

A non-transitory computer-readable medium stores computer-readable instructions that are executed by a processor of a sewing data generation device. The computer-readable instructions causing the processor to perform processes. The processes include data generating of generating sewing data for forming stitches along a plurality of lines arranged inside a sewing region in accordance with an arrangement condition, using a reference line as a reference. The plurality of lines include first to fourth lines. The first line is arranged at a position spaced from the reference line in a predetermined direction by a first distance. The second line and the third line are arranged adjacent to each other further in the predetermined direction than the first line, and are spaced from each other by a second distance. The fourth line are arranged at a position spaced from the third line in the predetermined direction by a third distance.

11 Claims, 7 Drawing Sheets

NON-TRANSITORY COMPUTER-READABLE MEDIUM AND SEWING MACHINE

REFERENCE TO RELATED APPLICATIONS

This application claims priority from Japanese Patent Application No. 2023-029770 filed on Feb. 28, 2023. The entire content of the priority application is incorporated herein by reference.

BACKGROUND ART

The present disclosure relates to a non-transitory computer-readable medium and a sewing machine.

With a known quilting data generation device, when a user selects a patchwork design and selects a quilting pattern, the quilting data generation device displays a layout along with the patchwork design and the quilting pattern. The device performs pattern division processing of dividing into divided patterns corresponding to each of pieces of the quilting pattern, and sets pattern data and thread colors of the divided patterns. The device gathers together the pattern data of the divided patterns having the same thread colors, and generates sewing data for the pattern data for each of the colors. The device writes the sewing data into a memory card.

SUMMARY

In quilting, a method called echo quilting exists in which stitches of a plurality of wave-like lines are disposed in a region surrounding a motif of a pattern and patchwork pieces and the like. In the known quilting data generation device, it takes time and effort to generate the sewing data for forming the stitches for the echo quilting of a design desired by the user.

Embodiments of the broad principles derived herein provide a non-transitory computer-readable medium storing a sewing data generation program, and a sewing machine that improve convenience for a user, compared to known art, when generating sewing data for echo quilting in which stitches are formed along each of a plurality of lines.

Embodiments provide a non-transitory computer-readable medium that stores computer-readable instructions that are executed by a processor of a sewing data generation device. The computer-readable instructions causing the processor to perform processes that include reference acquiring of acquiring a reference line arranged inside a sewing region, and condition acquiring of acquiring an arrangement condition for arranging a plurality of lines inside the sewing region. The processes further include data generating of generating sewing data for forming stitches along the plurality of lines. The plurality of lines are arranged inside the sewing region in accordance with the arrangement condition, using the reference line as a reference. The plurality of lines include a first line, a second line, a third line, and a fourth line. The first line is arranged at a position spaced from the reference line in a predetermined direction by a first distance. The second line and the third line are arranged adjacent to each other further in the predetermined direction than the first line, and are spaced from each other by a second distance. The fourth line are arranged at a position spaced from the third line in the predetermined direction by a third distance different from the second distance. When the instructions stored in the non-transitory computer-readable medium are executed by the sewing data generation device, the sewing data generation device contributes to setting the plurality of lines in which the second distance and the third distance are different from each other. Thus, the line setting of a sewing data generation program stored in the non-transitory computer-readable medium contributes to improving, compared to known art, convenience for a user when generating echo quilting sewing data for forming the stitches along each of the plurality of lines.

Embodiments further provide a sewing machine that includes a needle bar, a holder, a processor, and a memory. The needle bar is configured to move up and down to form stitches in a sewing object. The holder detachably mounts an embroidery frame. The holder is configured to move with respect to the needle bar. The memory stores computer-readable instructions that, when executed by the processor, instruct the processor to perform processes. The processes include reference acquiring of acquiring a reference line arranged inside a sewing region, and condition acquiring of acquiring an arrangement condition for arranging a plurality of lines inside the sewing region. The processes further include data generating of generating sewing data for forming stitches along the plurality of lines. The plurality of lines are arranged inside the sewing region in accordance with the arrangement condition, using the reference line as a reference and sewing of moving the needle bar and the holder in accordance with the sewing data to form stitches along the plurality of lines in the sewing object held by the embroidery frame. The plurality of lines include a first line, a second line, a third line, and a fourth line. The first line is arranged at a position spaced from the reference line in a predetermined direction by a first distance. The second line and the third line are arranged adjacent to each other further in the predetermined direction than the first line, and are spaced from each other by a second distance. The fourth line are arranged at a position spaced from the third line in the predetermined direction by a third distance different from the second distance. The sewing machine contributes to setting the plurality of lines in which the second distance and the third distance are different from each other. Thus, the sewing machine contributes to improving, compared to known art, convenience for a user when generating echo quilting sewing data for forming the stitches along each of the plurality of lines. The sewing machine contributes to forming the stitches along the plurality of lines in accordance with the generated sewing data.

DESCRIPTION

Figure 1:
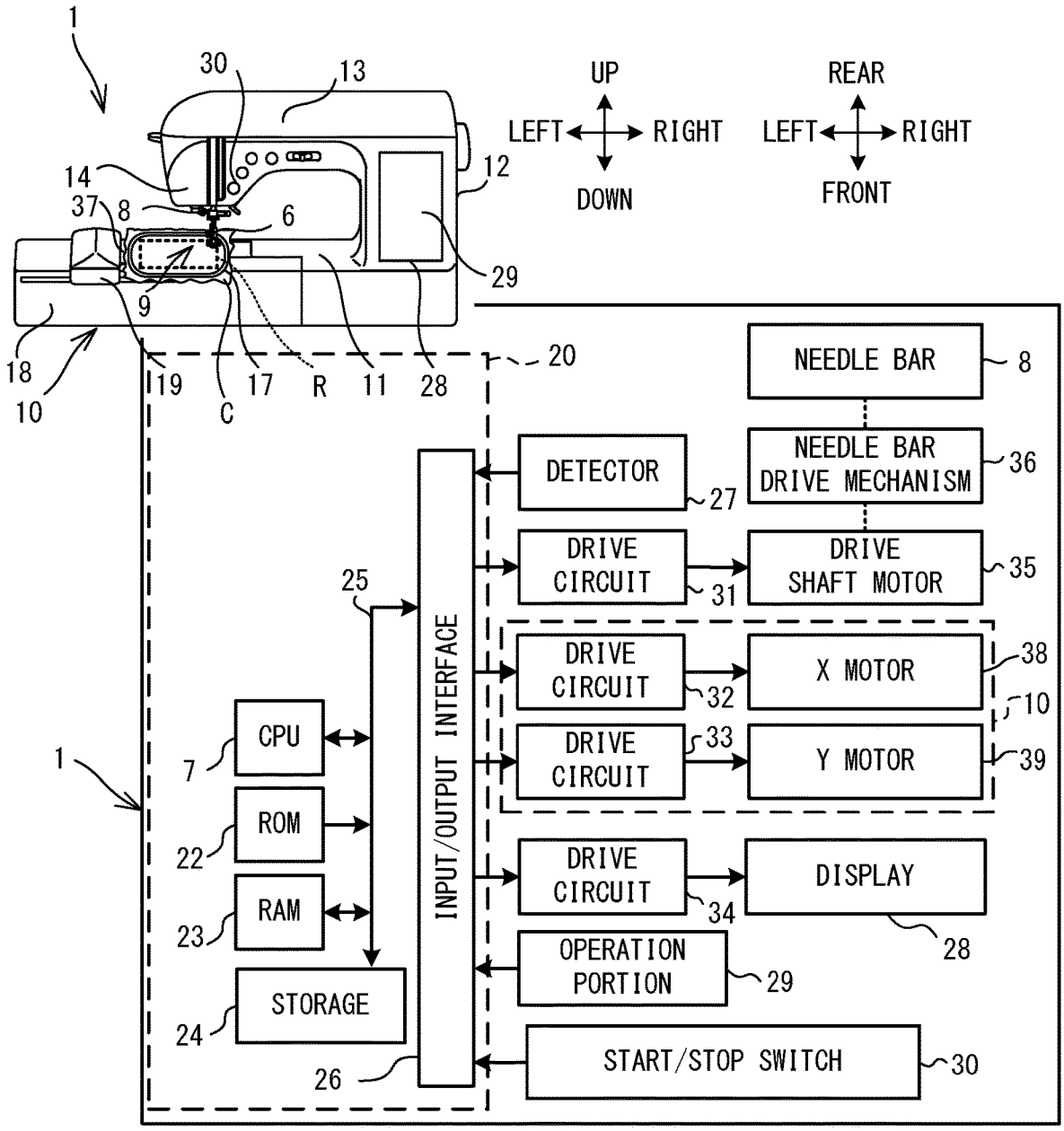
FIG. 1 is a block diagram showing an outline configuration of an embroidery sewing machine.

An embodiment of the present disclosure will be explained with reference to the drawings. As shown in FIG.

1, an embroidery sewing machine 1 (hereinafter referred to as the "sewing machine 1") is configured to perform embroidery sewing. The sewing machine 1 is provided with a bed 11, a pillar 12, an arm 13, a head 14, a sewing portion 9, and a movement mechanism 10. The bed 11 is a base of the sewing machine 2 and extends in the left-right direction. The pillar 12 is provided standing upward from the right end portion of the bed 11. A display 28 and an operation portion 29 are provided on the front surface of the pillar 12. The display 28 is a liquid crystal display and the operation portion 29 is a touch screen, for example. The arm 13 extends to the left from the upper end of the pillar 12, so as to face the bed 11. The head 14 is a portion coupled to the left leading end portion of the arm 13. The sewing portion 9 is provided with a presser bar which is not shown in the drawings, a needle bar 8, and a needle bar drive mechanism 36, and the like, are provided in the head 14. A sewing needle 6 is detachably mounted at the lower end of a needle bar 8. The sewing portion 9 is provided with a shuttle mechanism that is not shown in the drawings and is provided in the bed 11. The sewing portion 9 is configured to form stitches in a sewing object C, by pivoting the needle bar 8 in the up-down direction.

The movement mechanism 10 is provided with a holder 37 to which an embroidery frame 17 can be mounted and removed. The movement mechanism 10 is configured to move the holder 37 relative to the needle bar 8. The movement mechanism 10 is provided with a main body case 18 and a carriage 19. The main body case 18 houses an X-direction movement mechanism that is not shown in the drawings. The carriage 19 houses a Y-direction movement mechanism that is not shown in the drawings. At a time of embroidery sewing, a user mounts one of the embroidery frames, which is selected from among a plurality of the embroidery frames having different sizes each other, to the carriage 19. The embroidery frame 17 is moved, by the X-direction movement mechanism and the Y-direction movement mechanism, to needle drop points indicated by an XY coordinate system (an embroidery coordinate system) unique to the sewing machine 1. An X direction and a Y direction in the present embodiment are the left-right direction and the front-rear directions, respectively. The sewing machine 1 is configured to form an embroidery pattern on the sewing object C held by the embroidery frame 17, by driving the needle bar drive mechanism 36 and the shuttle mechanism of the sewing portion 9, in coordination with the movement of the embroidery frame 17.

The electrical configuration of the sewing machine 1 will be described. The sewing machine 1 is provided with a CPU 7, a ROM 22, a RAM 23, a storage 24, and an input/output (I/O) interface 26. The CPU 7 is configured to perform control of the sewing machine 1, and connected to the ROM 22, the RAM 23, the storage 24, and the I/O interface 26 via a bus 25. Drive circuits 31 to 34, the operation portion 29, a start/stop switch 30, and a detector 27 are connected to the I/O interface 26. The detector 27 is configured to detect that the embroidery frame 17 has been mounted to the movement mechanism 10, and to output a detection result according to a type of the embroidery frame 17. The storage 24 stores various setting values. The storage 24 is configured to store sewing data corresponding to each of a plurality of patterns that are candidates for a pattern to be sewn by the sewing machine 1.

A drive shaft motor 35 is connected to the drive circuit 31. The drive circuit 31 is configured to drive the drive shaft motor 35 in accordance with a control signal from the CPU 7. The needle bar drive mechanism 36 of the sewing portion 9 is driven in accordance with the driving of the drive shaft motor 35, and the needle bar 8 moves up and down. An X motor 38 is connected to the drive circuit 32. A Y motor 39 is connected to the drive circuit 33. The drive circuits 32 and 33 respectively are configured to drive the X motor 38 and the Y motor 39 in accordance with control signals from the CPU 7. The embroidery frame 17 mounted to the movement mechanism 10 is configured to move in the left-right direction (the X direction) and the front-rear direction (the Y direction) by movement amounts corresponding to the control signals, in accordance with the driving of the X motor 38 and the Y motor 39. The drive circuit 34 is configured to display an image on the display 28 in accordance with a control signal from the CPU 7.

Main processing of the sewing machine 1 will be described, with reference to FIG. 2 to FIG. 6B, using a case, as an example, in which a plurality of lines are set surrounding a periphery of a pattern E shown in FIG. 3. The pattern E shown in FIG. 3 is a pattern showing a house with six windows. The pattern E is sewn using threads of three colors. The main processing is performed when, in a screen for selecting an embroidery pattern, after a user has input the pattern E and the type of the embroidery frame 17 that is planned to be used, the user inputs a start command to activate the main processing. The type of the embroidery frame 17 is selected from among a plurality of types of embroidery frame stored in the storage 24, for example. When the CPU 7 of the sewing machine 1 detects the start command, the CPU 7 reads out, to the RAM 23, a sewing data generating program for executing the main processing stored in a program storage area of the ROM 22. In accordance with instructions included in the sewing data generating program read out to the RAM 23, the CPU 7 displays a screen 49 shown in FIG. 3 on the display 28, and executes the following steps. Various parameters necessary for executing the main processing are stored in the storage 24. Various data obtained in the course of the main processing are stored as appropriate in the RAM 23. Hereinafter, the plurality of lines surrounding the periphery of the pattern E will also be referred to as echo lines. A reference line arranged inside a sewing region R is a line used as a reference for setting the echo lines, and the reference line according to the present embodiment is an annular line surrounding the pattern E. The sewing region R is set inside the embroidery frame 17, and is a region in which the sewing machine 1 can perform embroidery sewing. A direction from the reference line according to the present embodiment toward the pattern E, or a direction approaching the reference line will also be referred to as an inner direction (an inner side). On the other hand, a direction from the pattern E toward the reference line or a direction separating from the reference line will also be referred to as an outer direction (an outer side). A reference sign, such as LN (N is a natural integer), is assigned to each of the plurality of lines, in order from the line closest to the reference line.

Figure 2:
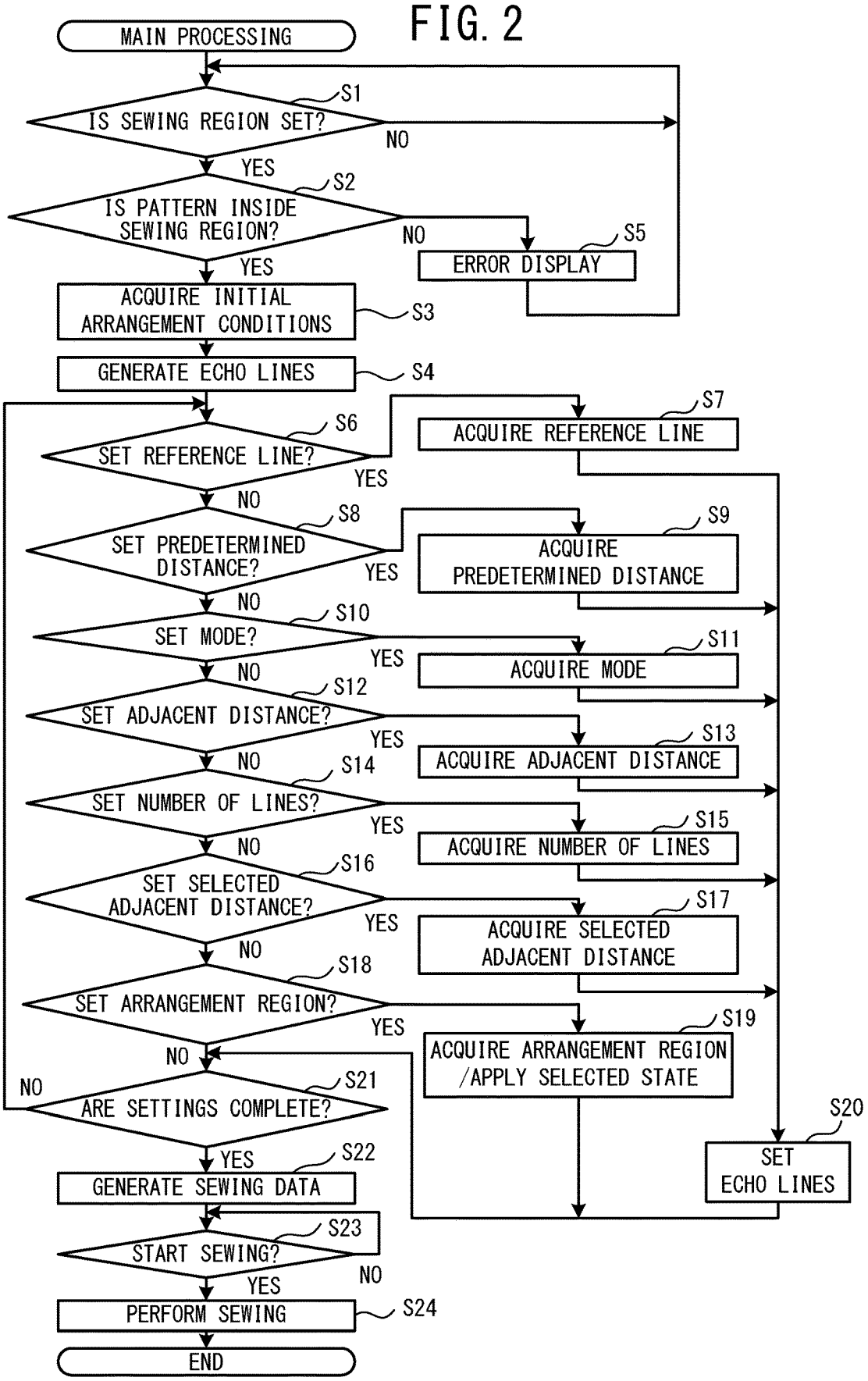
FIG. 2 is a flowchart of main processing performed by the embroidery sewing machine.
Figure 3:
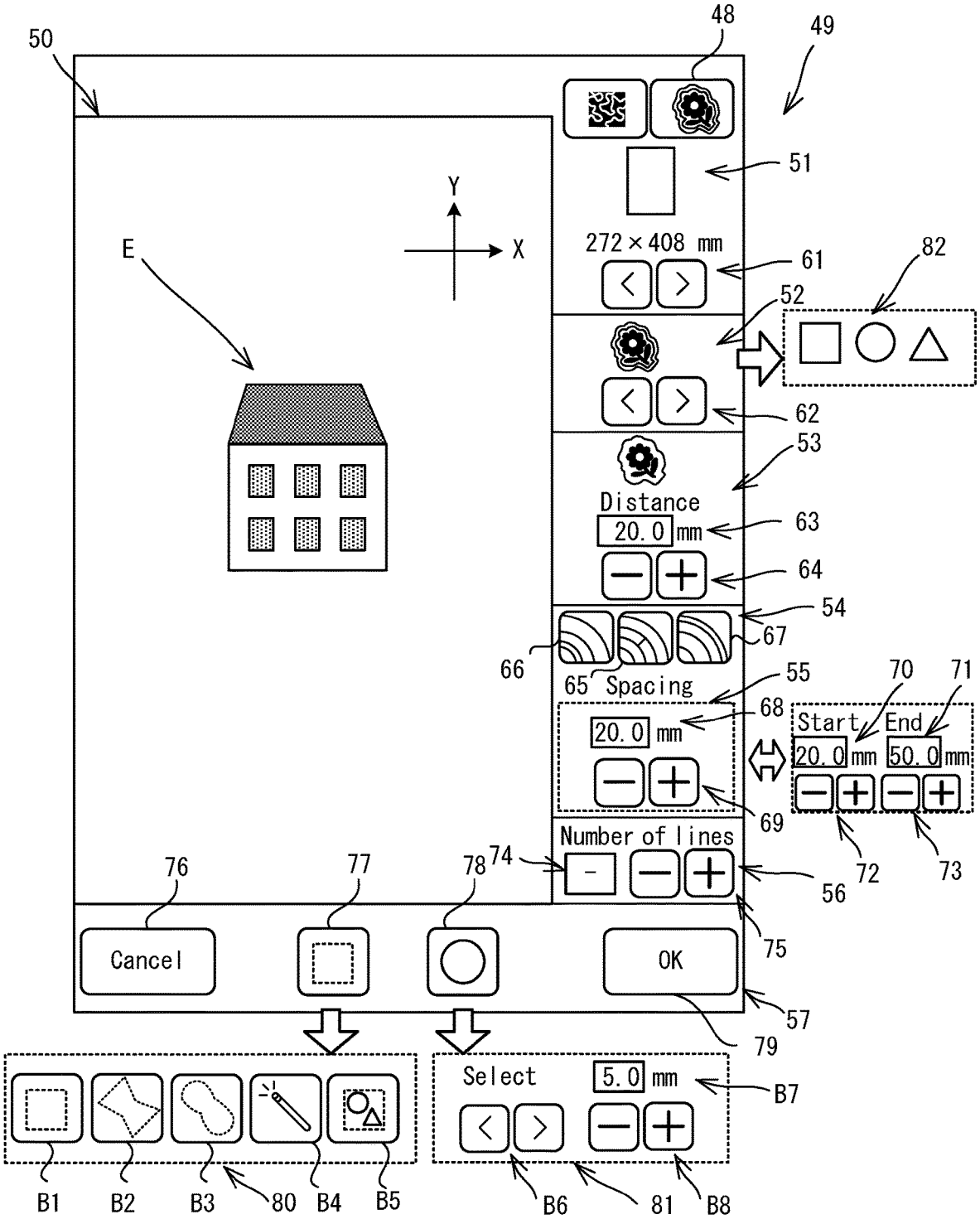
FIG. 3 is an explanatory diagram of a screen displayed on a display.

As shown in FIG. 2, the CPU 7 determines whether the sewing region is set (S1). When the sewing region is not set (no at S1), the CPU 7 stands by at S1 until the sewing region is set. Initial values of the sewing region are automatically set to values corresponding to the embroidery frame mounted to the holder 37, on the basis of the output result from the detector 27. When the sewing region R is set (yes at S1), the CPU 7 determines whether the pattern E specified by the start command is arranged inside the sewing region R for which the settings have been verified at S1 (S2). When the pattern E is not arranged inside the sewing region R (no at S2), the CPU 7 performs error display (S5), and returns the processing to S1.

When the pattern E is arranged inside the sewing region R (yes at S2), the CPU 7 acquires initial arrangement conditions of the plurality of lines to be arranged around the periphery of the pattern E. The initial arrangement conditions may be set in advance, may be set by the user, or may be automatically set while taking into consideration conditions up to a previous time. The arrangement conditions according to the present embodiment include the reference line, a distance between the pattern and the reference line, an arrangement mode, an adjacent distance, a number of lines, a selected adjacent distance, and an arrangement region. With the sewing machine 1 according to the present embodiment, each of the arrangement conditions can be set on the screen 49 shown in FIG. 3.

As shown in FIG. 3, the screen 49 is provided with fields 50 to 57. The field 50 displays a sewing image of stitches to be sewn inside the sewing region R. The up-down direction and the left-right direction of the field 50 respectively correspond to the Y direction and the X direction of the embroidery coordinate system. The selected pattern E is displayed in the field 50. The field 51 is a field for setting the sewing region R and is provided with keys 61. By operating the keys 61, the user can specify the sewing region R corresponding to the embroidery frame 17 that is planned to be used, from among sewing regions stored in the storage 24.

The field 52 is provided with keys 62 for setting the reference line. The reference line specified by the initial arrangement conditions is an annular line, along the contour of the pattern E, that is arranged to the outside from the contour of the pattern E by a predetermined distance. By depressing the keys 62, the user can select a given reference line from among options 82. The reference lines of the options 82 include, in addition to the initial annular line, shapes such as an equilateral triangle shape, a square shape, a circle, and the like that surround the pattern E. The reference line may be selected from among the options 82 stored in the storage 24, or may be a line of a desired shape drawn by the user.

The field 53 is provided with a field 63 displaying the predetermined distance, and keys 64 for setting the predetermined distance. It is sufficient that the predetermined distance prescribes the distance between the pattern and the reference line, which may be a minimum distance between the pattern and the reference line, or may be a distance between the pattern and a reference point on the reference line. The reference point may be selected from among an intermediate point, an apex, an end point, or the like of a side of the reference line. An initial value of the predetermined distance may be set by the user, or may be automatically set. A value of the predetermined distance in the field 63 is changed in accordance with an amount by which the keys 64 are operated.

The field 54 is provided with keys 65 to 67 for selecting the arrangement mode. The arrangement mode displays rules for arranging the plurality of lines. The arrangement mode according to the present embodiment includes, in addition to an equal interval selected using the key 65, a change condition to set an adjacent distance in a predetermined direction in a regular manner. The adjacent distances are distances in the predetermined direction between any given two of the lines that are adjacent, among the plurality of lines. The predetermined direction according to the present embodiment is a radial direction from a center of the pattern E toward the outside of the pattern E. The predetermined direction may be the single direction, or may be a plurality of directions. The change condition is selected from an increase condition that increases, in the regular manner, the adjacent distance in the predetermined direction selected by the key 66, and a decrease condition that decreases, in the regular manner, the adjacent distance in the predetermined distance selected by the key 67. The rules of the change condition may be set as applicable, and the adjacent distances may be set so as to be an arithmetical series, may be set so as to be a geometrical series, or may be defined using a given number sequence that changes a value thereof in a step-wise manner. The rules of the change condition may be set by the user, or may be set automatically in accordance with the other arrangement conditions.

The field 55 is a field for specifying a condition to set the interval between the plurality of lines. When the key 65 is selected in the field 54, in the field 55, a field 68 displaying the interval and a key 69 for setting the interval are displayed. In the field 54, when the key 66 or the key 67 are selected, in the field 55, a field 70 displaying an innermost interval, a field 71 displaying an outermost interval, a key 72 for setting the innermost interval, and a key 73 for setting the outermost interval are respectively displayed. The innermost interval is an interval between the reference line and the line closest to the reference line. The outermost interval is an interval, of the lines arranged inside the sewing region R, between the line furthest away from the center of the pattern E and the line that is closest to the furthest away line. Values of the fields 70 and 71 may be automatically set in accordance with the other arrangement conditions.

The field 56 is a field for setting a number of the plurality of lines (hereinafter referred to as the "number of lines"). The number of lines may include the reference line or need not necessarily include the reference line. A field 74 displaying the number of lines, and keys 75 for setting the number of lines are displayed in the field 56. A value of the number of lines of the field 74 is changed in accordance with an amount by which the keys 75 are operated. The CPU 7 may receive the change in the number of lines within a settable range, taking into account the other arrangement conditions, or may prioritize the condition of the number of lines over the other arrangement conditions and, when it is necessary to change the settings of the other arrangement conditions due to the change in the number of lines, may perform notification to that effect, or the other arrangement conditions may be automatically changed. The number of lines need not necessarily be set, and an initial number of lines according to the present embodiment is not set.

The field 57 displays keys 76 to 79. The key 76 is selected when canceling the setting of the echo lines. The key 77 sets the arrangement region. The arrangement region is set inside the sewing region R, is a region in which the echo lines are set, and is a region that is the same as the sewing region R or a region that is smaller than the sewing region R. The initial arrangement condition is the region that is the same as the sewing region R. When the key 77 is selected, options 80 including keys B1 to B5 are displayed as a pop up, and after the user has selected a desired setting method from among the displayed options 80, the arrangement region is set in the field 50. The key B1 is selected when setting the arrangement region using a rectangular shape. The key B2 is selected when setting the arrangement region using a polygonal shape. The key B3 is selected when setting the arrangement region using curved lines. The key B4 is selected when setting the arrangement region using an automatic selection. The key B5 is selected when setting the arrangement region using a rectangular shape surrounding a plurality of the patterns. The key 78 is selected when specifying the selected adjacent distance. The selected adjacent distance according to the present embodiment is a distance between a selected line and the line that is positioned further to the inner side than the selected line and is adjacent to the selected line. When the key 78 is selected, a field 81 is displayed as a pop up. The field 81 includes a key B6 for changing the selected line, a field B7 for displaying the selected adjacent distance, and a key B8 for setting the selected adjacent distance. The selected adjacent distance of the field B7 is changed in accordance with an amount by which the key B8 is operated. The key 79 is selected when ending the setting of the echo lines in the current settings.

The CPU 7 generates the echo lines surrounding the pattern E in accordance with the initial arrangement conditions acquired at S3 (S4). As shown by a screen G1 in FIG. 4A, the CPU 7 generates a reference line PL, where the distance between the pattern E and the reference line PL in each of the X direction and the Y direction of the embroidery coordinate system is a predetermined distance DB shown in the field 63. Using the reference line PL as a reference, the CPU 7 arranges lines L1 to L7 from the center of the pattern E toward the outer side at equal intervals, using an interval DS shown in the field 68. The lines L1 and L2 are annular and surround the pattern E. The lines L3 to L7 are lines of portions, of annular lines surrounding the pattern E, that are inside the sewing region R, and are not annular. Of the lines L1 to L7, the interval between any given two adjacent lines is the interval DS. The CPU 7 displays the generated echo lines on the display 28.

The CPU 7 determines whether a command to set the reference line has been input, based on whether the depression of the key 62 has been detected (S6). When, based on the depression of the key 62, the command has been detected (yes at S6) to set, as the reference line, the square shaped line that surrounds the pattern E, the CPU 7 acquires a reference line BL that is arranged inside the sewing region R, on the basis of the operation of the operation portion 29 detected at S6 (S7). The CPU 7 changes the currently set reference line PL to the newly set reference line BL, and generates the echo lines (S20). As shown by a screen G2 in FIG. 4B, the CPU 7 generates the reference line BL where the distance between the pattern E and the reference line BL in each of the X direction and the Y direction of the embroidery coordinate system is the predetermined distance DB shown in the field 63. At this time, the predetermined distance DB is prescribed by the minimum distance between the pattern E and the reference line BL. The CPU 7 arranges the plurality of lines from the reference line BL in the predetermined direction at equal intervals, using the interval DS shown in the field 68. The CPU 7 displays the lines L1 to L7 generated at S20 on the display 28. The CPU 7 determines whether a command has been input to end the setting for the echo lines, depending on whether the depression of the key 79 has been detected (S21). When the depression of the key 79 has not been detected (no at S21), the CPU 7 returns the processing to S6.

When the depression of the key 62 has not been detected (no at S6), the CPU 7 determines whether a command has been input to set the predetermined distance DB between the reference line BL and the pattern E, based on whether the depression of the key 64 has been detected (S8). When, based on the depression of the key 64, the command to set the predetermined distance DB has been detected (yes at S8), the CPU 7 acquires the predetermined distance DB between the pattern E and the reference line BL (S9), changes the distance between the pattern E and the reference line BL to the acquired predetermined distance DB, and generates the echo lines (S20). As shown by a screen G3 in FIG. 4C, the CPU 7 generates the lines L1 to L7 where the distance between the pattern E and the reference line BL in each of the X direction and the Y direction of the embroidery coordinate system is the predetermined distance DB shown in the field 63, and displays the generated lines L1 to L7 on the display 28. When the depression of the key 79 has not been detected (no at S21), the CPU 7 returns the processing to S6.

When the depression of the key 64 has not been detected (no at S8), the CPU 7 determines whether a command to set the mode has been input, based on whether the depression of any of the keys 65 to 67 has been detected (S10). When, based on the depression of the key 66, the command to set the increase condition has been detected (yes at S10), on the basis of the operation of the operation portion 29 detected at S10, the CPU 7 acquires the arrangement conditions (S11) including the increase condition that is the selected change condition, from among the increase condition that increases the adjacent distance in the regular manner in the predetermined direction, and the decrease condition that decreases the adjacent distance in the regular manner in the predetermined direction. In accordance with the increase condition that is the change condition, the CPU 7 sets a first distance D1, a second distance D2, and a third distance D3 to mutually different values, and sets the plurality of annular lines surrounding the reference line BL in the sewing region R (S20).

Figure 4A:
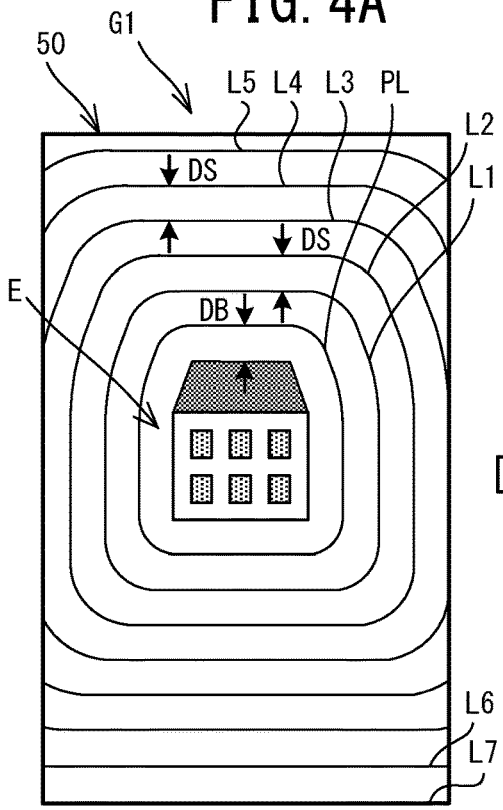
FIG. 4A to FIG. 4D are explanatory diagrams of screens displaying transitions of fields on the screen shown in FIG. 3.
Figure 4B:
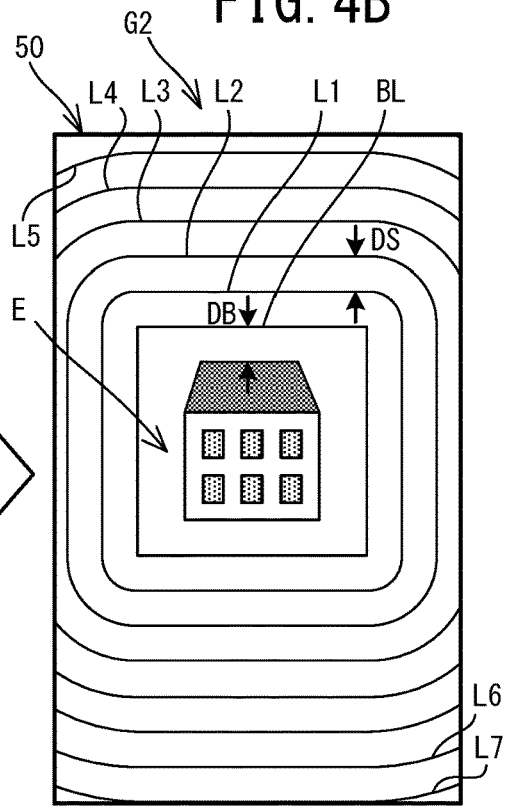
Figure 4C:
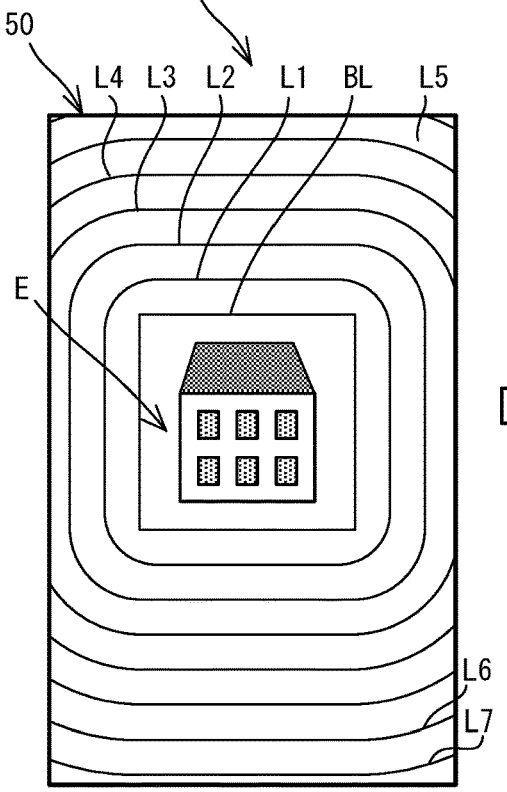
Figure 4D:
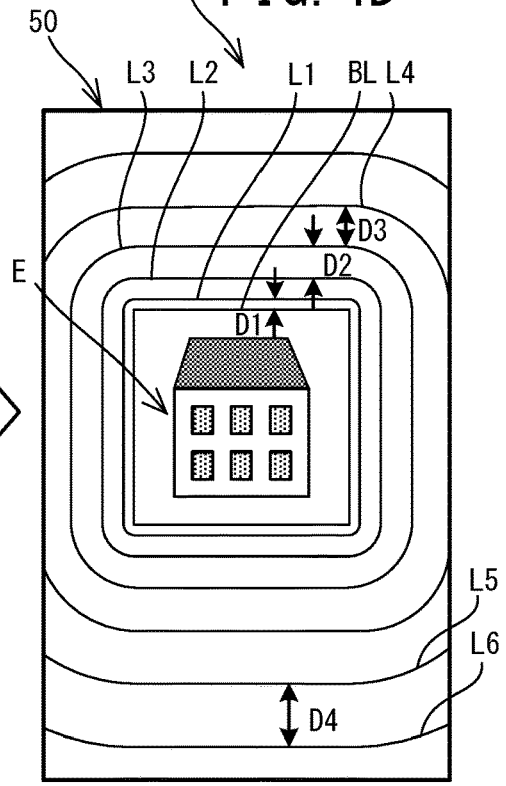

More specifically, as shown by a screen G4 in FIG. 4D, the CPU 7 arranges the first line L1 at a position separated by the first distance D1 in the predetermined direction from the acquired reference line BL. The CPU 7 arranges the second line and the third line to be adjacent to each other further in the predetermined direction than the first line L1, while being spaced from each other by the second distance D2. The second line and the third line are adjacent to each other. The second line is positioned further to the outer side than the first line L1, and is positioned further to the inner side than the third line. The adjacent distance between the second line and the third line is the second distance D2. The second line may be adjacent to the first line, or need not necessarily be adjacent to the first line. The CPU 7 arranges the fourth line to be spaced from the third line in the predetermined direction by the third distance D3 that is different to the second distance D2. Of the plurality of lines, which of the lines is defined as the second line may change as appropriate. For example, the second line is the line L2 adjacent to the first line L1, the third line is the line L3, and the fourth line is the line L4. The CPU 7 sets the innermost interval in each of the X direction and the Y direction of the embroidery coordinate system to be the first distance D1 shown in the field 70, and sets the interval between the line L5 and the line L6, which is the outermost interval, to be the fourth distance D4 shown in the field 71, and generates the lines L1 to L6. The CPU 7 displays the generated lines L1 to L6 on the display 28. The adjacent distances other than the first distance D1 and the fourth distance D4 are automatically set in accordance with the arrangement conditions that include the first distance D1 and the fourth distance D4. When the arrangement condition is the increase condition, the adjacent distances are the first distance D1, the second distance D2, the third distance D3, and the fourth distance D4 in ascending order of size, and the adjacent distance increases the further in the predetermined direction from the reference line BL. The processing is also performed in a similar manner when the arrangement condition is the decrease condition. When the arrangement condition is the decrease condition, the adjacent distances are the first distance D1, the second distance D2, the third distance D3, and the fourth distance D4 in descending order of size, and the adjacent distance decreases the further in the predetermined direction from the reference line BL. When the depression of the key 79 has not been detected (no at S21), the CPU 7 returns the processing to S6.

When the depression of any of the keys 65 to 67 has not been detected (no at S10), the CPU 7 determines whether a command to set the adjacent distance has been input (S12), based on whether the depression of any of the keys 69, 72, or 73 has been detected. When the depression of any of the keys 69, 72, or 73 has not been detected (no at S12), the CPU 7 determines whether a command to set the number of lines has been input (S14), based on whether the depression of the key 75 has been detected. When the command to set the number of lines to 9 has been detected based on the depression of the key 75 (yes at S14), the CPU 7 acquires the arrangement conditions including the number of the plurality of lines aligned in the predetermined direction that has been set on the basis of the operation of the operation portion 29 detected at S14 (S15). As shown by a screen G5 in FIG. 5A, the CPU 7 changes the number of lines to the set number of 9, and sets, in the sewing region R, the lines L1 to L9 including the first line L1, the second line L2, the third line L3, and the fourth line L4, as the plurality of lines of the number specified by the arrangement conditions (S20). The CPU 7 displays the generated number of lines on the display 28, and when the depression of the key 79 has not been detected (no at S21), the CPU 7 returns the processing to S6.

When, based on the depression of one selected from a group of the keys 69, 72, or 73, the command to set the adjacent distance has been detected (yes at S12), the CPU 7 acquires the adjacent distance to be set (S13). When the key 69 has been depressed, the adjacent distances of each of the lines are set to be the same, since the intervals between the plurality of lines are the equal interval. When the key 72 has been depressed, the adjacent distance between the reference line BL and the first line L1 is set. When the key 73 has been depressed, the adjacent distance between the line that is furthest to the outside and the line that is adjacent to the line furthest to the outside is set. Based on the set adjacent distance, the CPU 7 updates the distances between the adjacent lines of the plurality of lines, and generates the echo lines (S20).

Figure 5A:
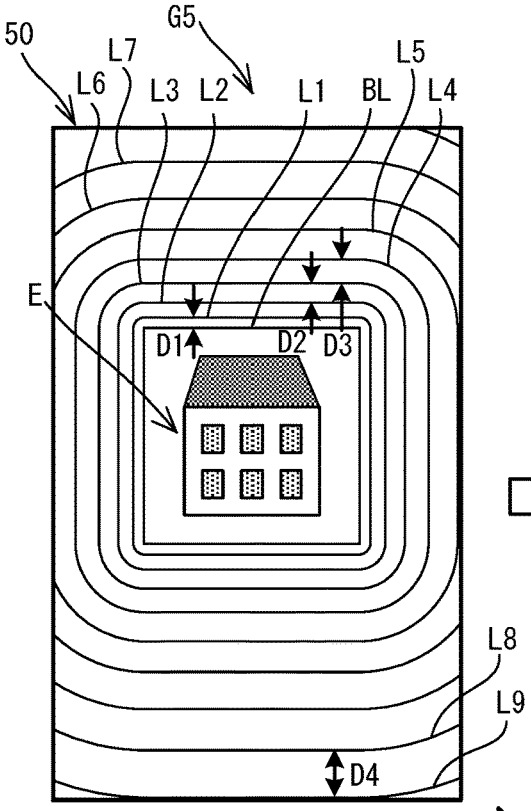
FIG. 5A to FIG. 5D are explanatory diagrams of screens displaying transitions of fields on the screen shown in FIG. 3.
Figure 5B:
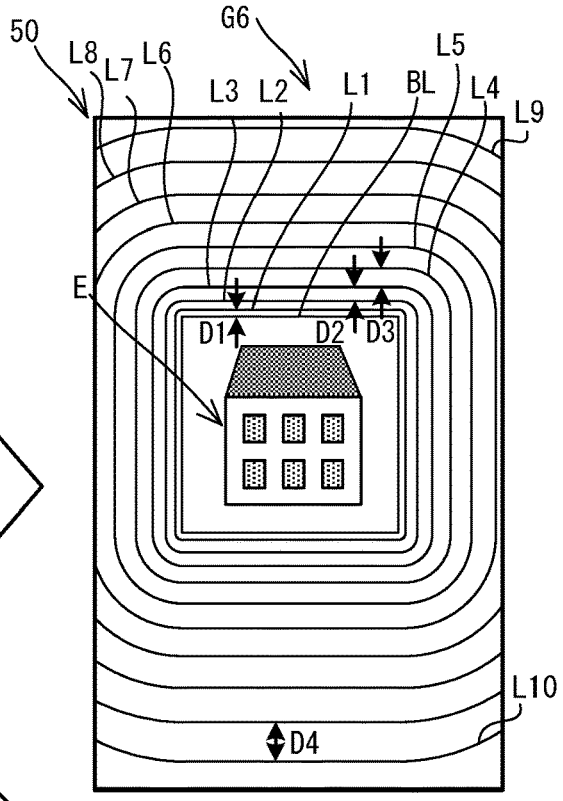
Figure 5C:
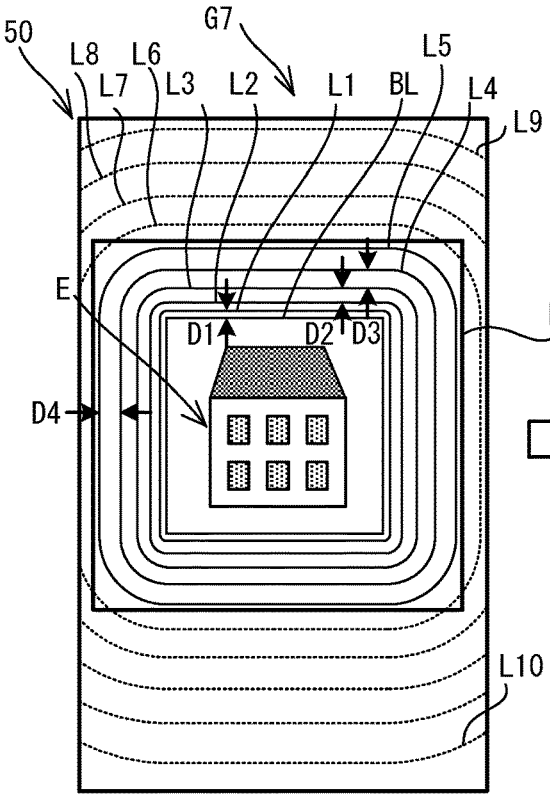
Figure 5D:
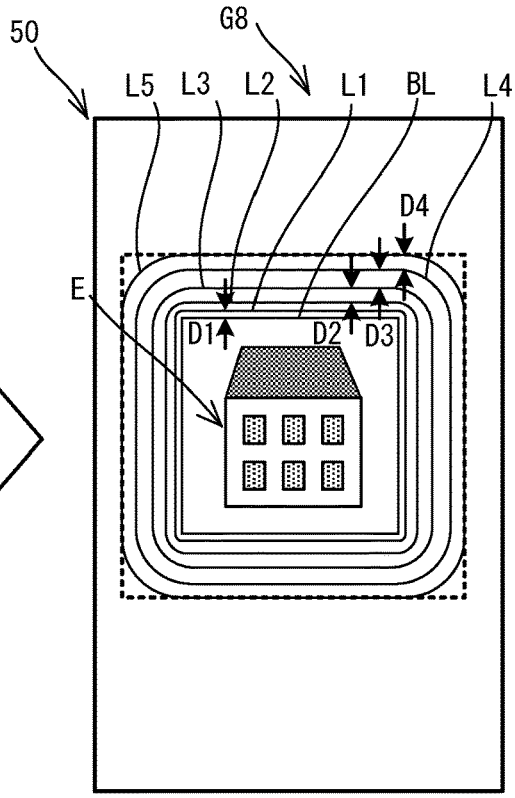
Figure 6A:
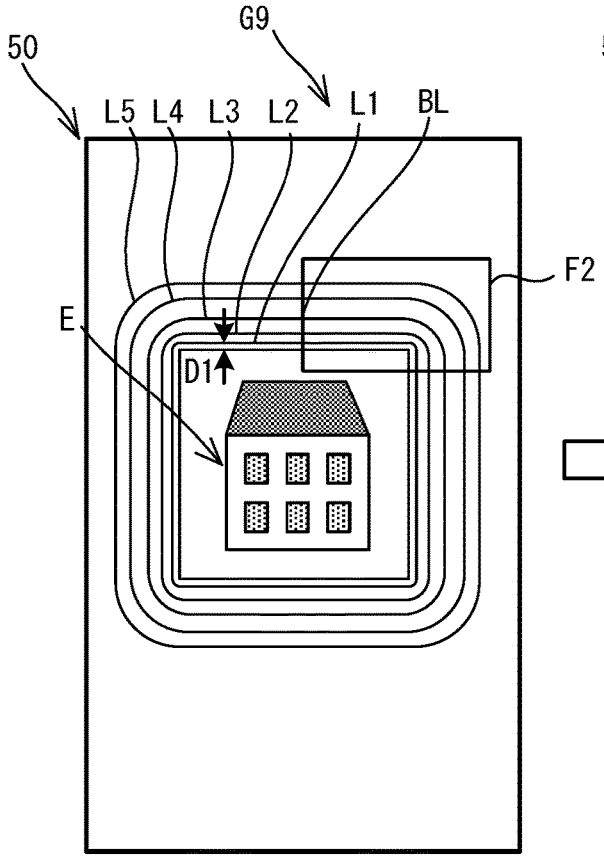
FIG. 6A and FIG. 6B are explanatory diagrams of screens displaying transitions of fields on the screen shown in FIG. 3.
Figure 6B:
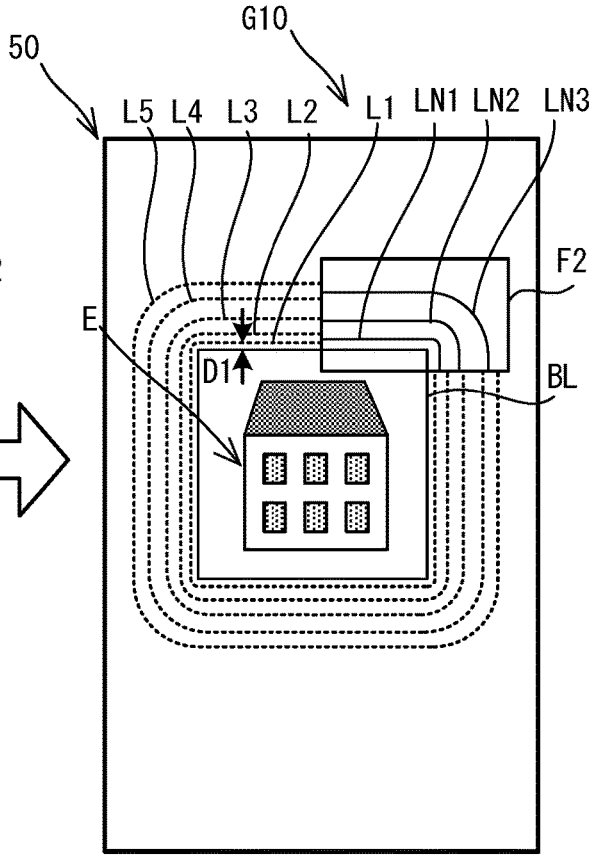

As shown by a screen G6 in FIG. 5B, the CPU 7 decides the adjacent distances that are the distances in the predetermined direction between the adjacent lines among the plurality of lines. Specifically, in each of the X direction and the Y direction of the embroidery coordinate system, the CPU 7 sets the innermost interval using the post-setting interval displayed in the field 70, and sets the outermost interval to the post-setting interval displayed in the field 71. The CPU 7 sets the adjacent distances that have not been set, in accordance with the set adjacent distances and the change condition. In other words, the adjacent distances set in the fields 70 and 71 can be referred to as the selected adjacent distances. For example, the adjacent distance between the reference line BL and the first line L1 set in the field 70 is the selected adjacent distance when the reference line BL and the first line L1 are the selected two lines. Thus, in accordance with the depression of the key 72 being detected, the CPU 7 sets the distance in the predetermined direction between the reference line BL and the first line L1, which are the two lines selected from the plurality of lines, to the selected adjacent distance specified by the arrangement conditions, namely, to the value of the field 70. The CPU 7 generates the plurality of lines and displays the generated plurality of lines on the display 28. When setting the plurality of lines in accordance with the adjacent distances, when the number of the lines specified by the number of lines cannot be set inside the sewing region R, the CPU 7 may display an error, may automatically change the number of lines, or may cancel the change to the adjacent distance. As shown by the screen G6 in FIG. 5B, when the CPU 7 according to the present embodiment sets the plurality of lines in accordance with the set adjacent distances, when the number specified by the number of lines is 12, for example, and the number of the lines specified by the number of lines cannot be set inside the sewing region R, the CPU 7 automatically changes the number of lines to 10, which is the number of lines that can be set inside the sewing region R. When the depression of the key 79 has not been detected (no at S21), the CPU 7 returns the processing to S6.

When the depression of the key 75 has not been detected (no at S14), by detecting whether the depression of the key B8 has been detected in a state in which the key 78 is selected, the CPU 7 determines whether a command to set the selected adjacent distance has been input (S16). When the depression of the key B8 has not been detected (no at S16), by detecting whether any of the keys B1 to B5 has been depressed in the state in which the key 77 is selected, and a command has been detected to select part of the field 50, the CPU 7 determines whether a command to set the arrangement region has been input (S18). As shown by a screen G7 in FIG. 5C, when the command has been detected to set a region indicated by a square shape surrounding the line L4 as an arrangement region F1 (yes at S18), the CPU 7 acquires the arrangement region F1, and sets the arrangement region F1 that is smaller than the sewing region R, for arranging the plurality of lines in the sewing region R (S19). The CPU 7 causes the arrangement region F1 to be in a selected state. The CPU 7 returns the processing to S6. When the command to set the arrangement conditions is input in the state in which the arrangement region F1 is selected, the input settings are only effective inside the arrangement region F1, and are not applied outside the arrangement region F1. In other words, when the new arrangement conditions are acquired in the state in which the arrangement region F1 is set in which the plurality of lines are to be arranged, in accordance with the new arrangement conditions, the CPU 7 re-sets the some of the plurality of lines that are inside the arrangement region F1, and does not re-set the some of the plurality of lines that are outside the arrangement region F1. In the present embodiment, in accordance with the commands of the user, the CPU 7 causes elimination processing (not shown in the drawings) to be performed, and eliminates the lines L7 to L10 positioned outside the arrangement region F1, and the line L6 of which a part enters inside the arrangement region.

When, by the depression of the key B8, the command to set the selected adjacent distance has been detected in a state in which the line L5 is selected by the key B6 (yes at S16), the CPU 7 acquires the arrangement conditions including the selected adjacent distance (S17). As shown by a screen G8 in FIG. 5D, the CPU 7 generates the echo lines under conditions in which only the selected adjacent distance has been changed (S20). In the screen G8, the intervals between the lines L1 to L4 are not changed, and only the adjacent distance of the line L5 is changed to the value displayed in the field B7, which is the set value. The CPU 7 displays the generated plurality of lines on the display 28, and when the depression of the key 79 has not been detected (no at S21), the CPU 7 returns the processing to S6.

When the depression of any of the keys B1 to B5 has not been detected (no at S18), and the depression of the key 79 has not been detected (no at S21), the CPU 7 returns the processing to S6. As shown by a screen G9 in FIG. 6A, when the command has been detected to set a region indicated by a square shape surrounding the reference line BL and the upper right portions of the lines L1 to L5 as an arrangement region F2 (yes at S18), the CPU 7 acquires the arrangement region F2, and sets the arrangement region F2 that is smaller than the sewing region R, for arranging the plurality of lines in the sewing region R (S19). The CPU 7 causes the arrangement region F2 to be in the selected state. When the command has been detected to set the number of lines to 3 in the state in which the arrangement region F2 is selected (yes at S14), the CPU 7 acquires 3 as the set number of lines (S15). When the operation of the keys 72 and 73 has been detected (yes at S12), the CPU 7 acquires the set adjacent distances (S13). As shown by a screen G10 in FIG. 6B, the CPU 7 applies the input setting inside the arrangement region F2, and, in place of the lines L1 to L5, sets lines LN1 to LN3 inside the arrangement region F2 (S20). The CPU 7 does not apply the input setting outside the arrangement region F2, and the lines L1 to L5 remain outside the arrangement region F2. The CPU 7 according to the present embodiment does not change the reference line BL, and does not include the reference line BL in the number of lines.

After verifying the sewing image of the echo lines displayed on the display 28, the user depresses the key 79. When the depression of the key 79 has been detected (yes at S21), the CPU 7 generates the sewing data for sewing the stitches along the plurality of lines set by the processing at S20 (S22). The CPU 7 generates the sewing data for sewing the echo lines generated by the processing at S4 or S20, and the pattern E (S22). The CPU 7 generates, as the sewing data of the echo lines, the sewing data for forming predetermined stitches along the plurality of lines set by the processing at S20. The predetermined stitches are running stitches of a predetermined length. The lines LN1 to LN3 may be or need not necessarily be connected to any one of the lines among the lines L1 to L5. The colors of the threads for sewing the lines L1 to L5, and the lines LN1 to LN3 may be automatically set, or may be set by the user. It is sufficient that a sewing order of the echo lines and the pattern E be set as appropriate, and the sewing order may be set such that the echo lines are sewn after the pattern E, the sewing order may be set such that the pattern E is sewn after the echo lines, or the sewing order may be set such that the echo lines are sewn while sewing the pattern E.

Based on whether the depression of the start/stop switch 30 has been detected, the CPU 7 determines whether a command to start the sewing has been detected (S23). When the command to start the sewing has not been detected (no at S23), the CPU 7 stands by until the command to start the sewing is detected. When the command to start the sewing has been detected (yes at S23), the CPU 7 controls the sewing portion 9 and the movement mechanism 10 in accordance with the sewing data generated by the processing at S22, and forms the stitches of the pattern E and the echo lines on the sewing object C held by the embroidery frame 17 (S24). The CPU 7 thus ends the main processing.

The sewing machine 1 according to the above-described embodiment is provided with the operation portion 29 and the CPU 7. The CPU 7 acquires the reference line BL arranged inside the sewing region R (S7). The CPU 7 acquires the arrangement conditions for arranging the plurality of lines inside the sewing region R (S11, S13, S15, and S17). In accordance with the arrangement conditions and using the reference line BL as the reference, the CPU 7 generates the sewing data for forming the stitches along the plurality of lines inside the sewing region (S20, S22). The CPU 7 drives the sewing portion 9 and the movement mechanism 10 in accordance with the generated sewing data, and forms the stitches along the plurality of lines in the sewing object C held by the embroidery frame 17 (S24). The CPU 7 arranges the first line L1 at a position spaced from the acquired reference line BL by the first distance D1 in the predetermined direction. The CPU 7 arranges the second line L2 and the third line L3 further in the predetermined direction than the first line L1, so as to be adjacent to each other and spaced from each other by the second distance D2. The CPU 7 arranges the fourth line L4 to be spaced from the third line L3 in the predetermined direction by the third distance D3 that is different from the second distance D2. When the sewing data generation program is executed, the sewing machine 1 can set the plurality of lines at the mutually different second distance D2 and third distance D3. Thus, S20 contributes to improving convenience for the user, compared to the known art, when generating the echo quilting sewing data that forms the stitches along each of the plurality of lines.

The arrangement conditions include the change condition to set the adjacent distance in the predetermined direction in the regular manner, when comparing the adjacent distances, which are the distances in the predetermined direction between any given two of the lines that are adjacent, among the plurality of lines. The CPU 7 sets the first distance D1, the second distance D2, and the third distance D3 to the mutually different values in accordance with the change condition, and sets the plurality of lines inside the sewing region R (S20). When the sewing data generation program is executed, the sewing machine 1 can automatically set the plurality of lines for which the adjacent distance changes in the regular manner in the predetermined direction. The sewing machine 1 can omit the time and effort for the user to individually calculate and set each of the adjacent distances such that the adjacent distance changes in the regular manner. The sewing machine 1 can reduce incidents in which the echo lines desired by the user are not generated due to calculation mistakes or input errors of the adjacent distances. Thus, the line setting steps of the sewing data generation program can improve the convenience for the user, compared to the known art, when generating the echo quilting sewing data.

In the processing at S20, based on the operation of the operation portion 29, the CPU 7 acquires the arrangement conditions including the change condition selected from among the increase condition that increases the adjacent distance in the predetermined direction in the regular manner, and the decrease condition that decreases the adjacent distance in the predetermined in the regular manner (S11). When the sewing data generation program is executed, the sewing machine 1 can improve the convenience for the user, when generating the echo quilting sewing data, compared to a case in which it is not possible to select the change condition from among the increase condition and the decrease condition.

The CPU 7 acquires the arrangement conditions including the number of the plurality of lines aligned in the predetermined direction and set on the basis of the operation of the operation portion 29 (S15). The CPU 7 sets the plurality of lines of the number specified by the arrangement conditions inside the sewing region R (S20). When the sewing data generation program is executed, the sewing machine 1 can arrange the specified number of lines in accordance with the arrangement conditions. The sewing machine 1 can improve the convenience for the user, when generating the echo quilting sewing data, compared to a case in which the number of the plurality of lines cannot be set.

At S20, the CPU 7 sets the plurality of annular lines surrounding the reference line, in accordance with the arrangement conditions (S20). When the sewing data generation program is executed, the sewing machine 1 can arrange the plurality of annular lines surrounding the reference line in accordance with the arrangement conditions. When the annular lines surrounding the reference line are arranged in accordance with the arrangement conditions, the CPU 7 does not generate the lines for portions outside the sewing region R. Thus, the sewing machine 1 can reliably avoid defects caused by generating the lines outside the sewing region R.

The CPU 7 acquires the arrangement conditions including the selected adjacent distance decided on the basis of the operation of the operation portion 29 (S17), and sets the distance in the predetermined direction between the selected two of the lines that are adjacent to each other, from the plurality of lines, to the selected adjacent distance specified by the arrangement conditions (S20). When the sewing data generation program is executed, the sewing machine 1 can improve the convenience for the user, when generating the echo quilting sewing data, compared to a case in which the selected adjacent distance cannot be specified.

The CPU 7 acquires the arrangement conditions including the selected adjacent distance (S13). The CPU 7 sets the distance in the predetermined direction between the selected two of the lines that are adjacent to each other, from among the plurality of lines, to the selected adjacent distance specified by the arrangement conditions, and sets the adjacent distance that is not set by the selected adjacent distance in accordance with the selected adjacent distance and the change condition (S20). When the sewing data generation program is executed, the sewing machine 1 can improve the convenience for the user, when generating the echo quilting sewing data, compared to a case in which the selected adjacent distance cannot be specified. With respect to any two given adjacent lines for which the selected adjacent distance is not specified, the sewing machine 1 can automatically perform the settings in accordance with the selected adjacent distance and the change condition. The sewing machine 1 can allow the user to separately set the selected adjacent distance while omitting the time and effort for the user to separately set all of the adjacent distances.

The CPU 7 sets the arrangement region that is smaller than the sewing region R, for arranging the plurality of lines in the sewing region R (S19). The CPU 7 arranges the plurality of lines inside the arrangement region. When the sewing data generation program is executed, the sewing machine 1 can set the plurality of lines in the arrangement region only. Compared to a case in which the arrangement region cannot be set, the sewing machine 1 can improve the convenience for the user, when generating the echo quilting sewing data.

When the new arrangement conditions are acquired in the state in which the arrangement region in which the plurality of lines are arranged is set, the CPU 7 re-sets the some of the plurality of lines that are inside the arrangement region in accordance with the new arrangement conditions, and does not re-set the some of the plurality of lines that are outside the arrangement region (S20). When the sewing data generation program is executed, the sewing machine 1 can re-set the plurality of lines in accordance with the new arrangement conditions for only the some of the lines arranged inside the arrangement region. The sewing machine 1 can improve the convenience for the user, when generating the echo quilting sewing data, compared to a case in which it is not possible to set the plurality of lines in accordance with the new arrangement conditions for the plurality of lines inside the arrangement region only.

The CPU 7 acquires, as the reference line BL, the line selected from among the plurality of lines on the basis of the operation of the operation portion 29 (S7). When the sewing data generation program is executed, the sewing machine 1 can set the plurality of lines as the reference line of the shape selected by the user. Compared to a case in which it is not possible to select the reference line, the sewing machine 1 can improve the convenience for the user, when generating the echo quilting sewing data.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The non-transitory computer-readable medium and the sewing machine according to the present disclosure are not limited to the above-described embodiment, and various modifications may be added insofar as they do not depart from the scope and gist of the present disclosure. For example, the following modifications may be added as appropriate. The present disclosure can be implemented in various modes, and, for example, may be realized in a format of a sewing data generation method or the like that is executed by the control portion of the sewing data generation device.

(A) The configuration of the sewing machine 1 may be changed as appropriate. It is sufficient that the sewing machine 1 be able to perform embroidery sewing, and the sewing machine 1 may be an industrial sewing machine or a multi-needle sewing machine provided with a plurality of needle bars. The sewing machine 1 is the multi-needle sewing machine, but the number of needle bars is not particularly limited. The processing from S1 to S22 may be performed in a sewing data generation device other than the sewing machine 1. The sewing data generation device may be a dedicated device, or may be a general-purpose device, such as a mobile terminal device including a mobile phone (a smartphone, for example), a PDA, a tablet PC, and the like, a PC or the like. It is sufficient that the display 28 be able to display an image, and the display 28 may be, for example, an organic EL display, a plasma display, a plasma tube array display, an electronic paper display that uses electrophoresis, or the like. In addition to the touch panel, the operation portion 29 may be a keyboard, a mouse, a switch, a joystick, or the like. The sewing machine 1 may be provided with a communication portion for communicating with another device.

(B) The program including the instructions to execute the main processing shown in FIG. 2 may be stored in a storage device of the sewing machine 1 until the program is executed by the CPU 7. Thus, a program acquisition method, an acquisition path, and a device storing the program may be changed, respectively, as appropriate. The program executed by the CPU 7 may be received from another device via cable or wireless communication, and may be stored in a storage device, such as the storage 24 or the like. The other device includes a PC, and a server connected via a network, for example.

(C) Each of the steps of the main processing shown in FIG. 2 is not limited to the example of being executed by the CPU 7, and part or all of the processing may be executed by another electronic device (an ASIC, for example). Each of the steps of the main processing may be executed by distributed processing by a plurality of electronic devices (a plurality of CPUs, for example). The order of each of the steps of the main processing may be changed, the step may be omitted, or a step may be added, as necessary. For example, the following changes may be added to the main processing as appropriate.

The processing to set the plurality of lines may be changed as appropriate in accordance with the arrangement conditions. It is sufficient that the arrangement conditions include information specifying the reference line, and at least one selected from a group of the distance between the pattern and the reference line, the arrangement mode, the adjacent distances, the number of lines, the selected adjacent distance, and the arrangement region may be omitted, or another condition may be added. The other condition is, for example, a mathematical formula that specifies the change condition, such as an arithmetic sequence, a geometric sequence, or the like, a parameter, and the like. For example, as the arrangement conditions, the CPU 7 may acquire conditions including a first term and a tolerance of an arithmetic sequence, and may set each of the adjacent distances and set the plurality of lines in accordance with the acquired arithmetic sequence. The predetermined direction need not necessarily be the direction extending in the radial direction from the center of the pattern. The predetermined direction may be a direction toward the center of the annular reference line. The reference line need not necessarily be the annular shape surrounding the pattern, and may be an annular line from which the pattern is omitted, or may be a straight line or a curved line that is not annular. The reference line may be a contour line of the pattern. As the arrangement condition, the CPU 7 may be able to set only one selected from a group of the increase condition and the decrease condition. A method of setting the arrangement region may be changed as appropriate, and the shape of the arrangement region may be set from among the options 82 that are the same for the reference line. The one or more lines outside of the arrangement region may be automatically deleted, may be deleted when specified by the user, or need not necessarily be deleted. A configuration may be adopted in which the reference line cannot be selected by the user, and in this case, it is sufficient that the CPU 7 automatically sets the reference line. The arrangement conditions may include a condition that changes the adjacent distance in an irregular manner in the predetermined direction, by setting random numbers as the adjacent distances.

Figure 7A:
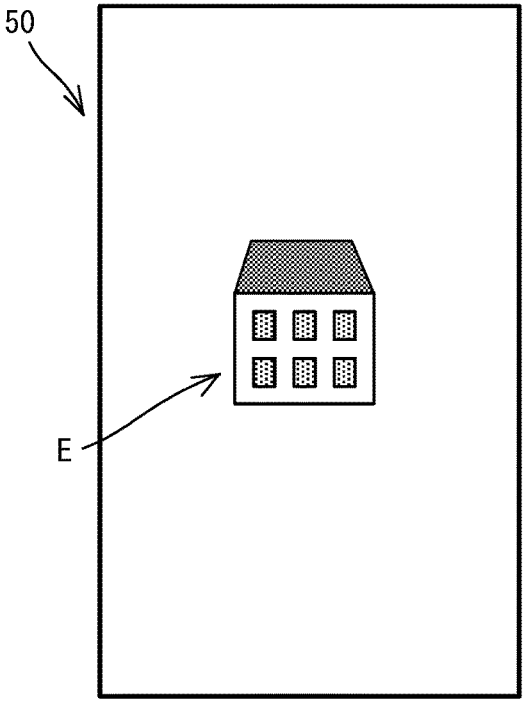
FIG. 7A to FIG. 7D are explanatory diagrams of screens of a modified example displaying transitions of fields on the screen shown in FIG. 3.
Figure 7B:
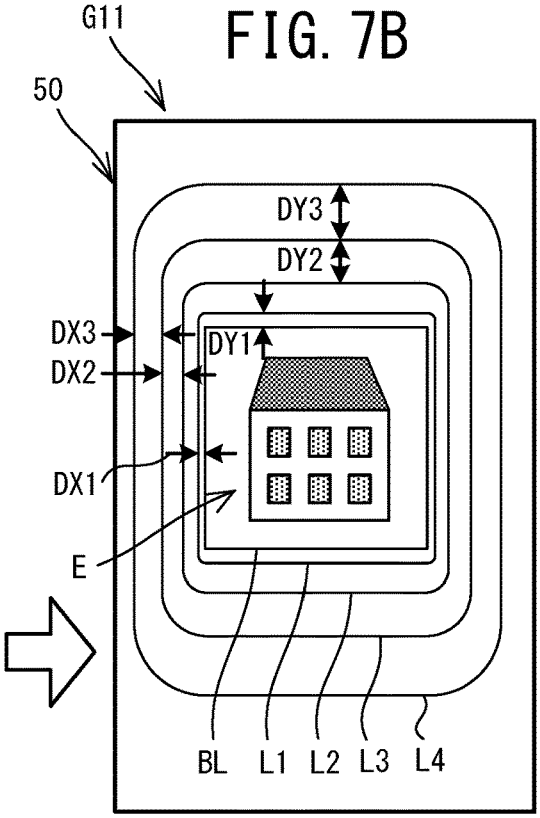

The arrangement conditions may include a condition to set the adjacent distances in each of a plurality of predetermined directions, in accordance with mutually different rules. For example, in the same specific example pattern E as in the above embodiment, displayed in the field 50 shown in FIG. 7A, when the rectangular arrangement region that is long in the Y direction of the embroidery coordinate system is set, and rules that mutually differ between the X direction and the Y direction are set in accordance with the shape of the arrangement region, as shown by a screen G11 in FIG. 7B, the CPU 7 may set the square reference line BL, and the lines L1 to L4 with respect to the pattern E. A first distance DY1 between the reference line BL and the line L1 in the Y direction and a first distance DX1 in the X direction are set to mutually different values. In a similar manner, the CPU 7 may set a second distance DY2 between the line L2 and the line L3 in the Y direction and a second distance DX2 in the X direction to mutually different values, and may set a third distance DY3 between the line L3 and the line L4 in the Y direction and a third distance DX3 in the X direction to mutually different values. Mutually different change conditions may be set in accordance with the predetermined direction, such as setting the increase condition in the X direction and the decrease condition in the Y direction. Of the plurality of lines, it is sufficient that each of the second to the fourth lines are the lines positioned in the predetermined direction with respect to the first line, and are not limited to the lines L2 to L4, and may be the lines L4 to L6, for example. The third distance D3 may the same as the first distance D1. An arrangement may be included such that the adjacent distances are the same, of the plurality of lines.

Figure 7C:
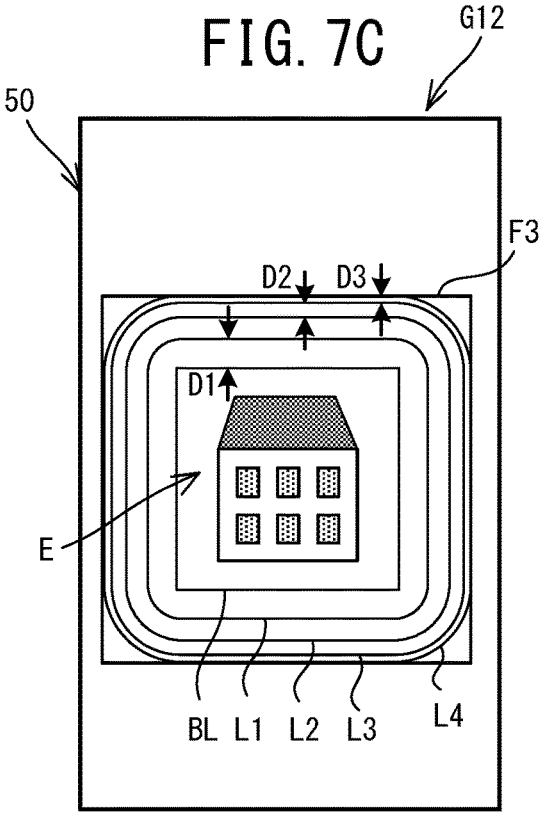
Figure 7D:
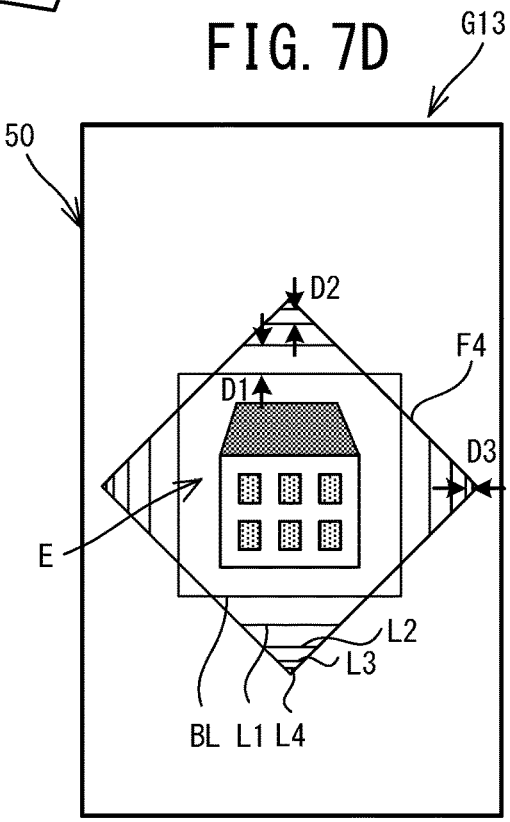

As shown by a screen G12 in FIG. 7C, in accordance with the distance between the contour of an arrangement region F3 and the reference line BL and with the arrangement conditions, the CPU 7 may set the adjacent distances in accordance with the decrease condition, such that the line L4 that is separated furthest from the reference line BL in the predetermined direction is arranged on the contour of the arrangement region F3 and may set the lines L1 to L4. When the arrangement condition is the decrease condition, the adjacent distances are the first distance D1, the second distance D2, and the third distance D3 in descending order of size, and the adjacent distance decreases the further in the predetermined direction from the reference line BL. In another example, as shown by a screen G13 in FIG. 7D, when a diamond-shaped arrangement region F4 is set, the CPU 7 may set the lines L1 to L4 having the first distance D1, the second distance D2, and the third distance D3 in the same manner as the case shown by the screen G12, and may delete portions thereof outside the arrangement region F4. In this case, any one selected from a group of the lines L1 to L4 is arranged in accordance with the decrease condition but is not annular. The sewing data may be generated for forming the stitches along the contour of the shape specified by the arrangement region F4, or need not necessarily be generated. In another example, the CPU 7 may set the plurality of lines in a range in which the annular lines can be set, inside the sewing region R. In this case, in the example shown by the screen G4, the CPU 7 may generate the reference line BL and the lines L1 to L3, and need not necessarily generate the lines L4 to L6 of which portions are outside the sewing region R when arranged in the annular shape.

The configuration, arrangement, and the like of the screen 49 shown in FIG. 3 may be changed as appropriate. The screen 49 need not necessarily be provided with the field 55. In this case, for example the field 54 may combine the function of the field 55, and the CPU 7 may increase the interval from an initial value by a predetermined value in accordance with the depression of the key 66 of the field 54, and may decrease the interval by a predetermined value in accordance with the depression of the key 67. At this time, the initial value and the predetermined value may be set in advance, or a configuration may be adopted in which the initial value and the predetermined value can be set by the user. The above-described embodiment and each of the above-described modified examples may be combined insofar as no contradictions arise.

What is claimed is:

1. A non-transitory computer-readable medium storing computer-readable instructions that are executed by a processor of a sewing data generation device, the computer-readable instructions causing the processor to perform processes comprising:

reference acquiring of acquiring an embroidery pattern to be sewn that is arranged inside a sewing region, and a reference line arranged inside a sewing region, the reference line being a line surrounding and arranged entirely outside the embroidery pattern;

condition acquiring of acquiring an arrangement condition for arranging a plurality of lines inside the sewing region and outside the embroidery pattern; and data generating of generating sewing data for forming stitches along the plurality of lines, the plurality of lines being arranged inside the sewing region and outside the embroidery pattern in accordance with the arrangement condition using the reference line as a reference, the plurality of lines including a first line, a second line, a third line, and a fourth line, the first line being arranged at a position spaced outside the reference line in a predetermined direction by a first distance, the second line and the third line being arranged adjacent to each other further in the predetermined direction than the first line, the second line and the third line being spaced from each other by a second distance, the fourth line being arranged at a position spaced from the third line in the predetermined direction by a third distance different from the second distance.

2. The non-transitory computer-readable medium according to claim 1, wherein the arrangement condition includes a change condition to set adjacent distances in the predetermined direction according to a first defined pattern, the adjacent distances being distances in the predetermined direction between any two of the lines that are adjacent to each other, of the plurality of lines, and the data generating includes setting the first distance, the second distance, and the third distance to mutually different values in accordance with the change condition, and setting the plurality of lines inside the sewing region.

3. The non-transitory computer-readable medium according to claim 2, wherein the condition acquiring includes acquiring, based on operation of an operation portion provided in the sewing data generation device, the arrangement condition including the change condition selected from among an increase condition and a decrease condition, the increase condition increasing the adjacent distances in the predetermined direction according to a second defined pattern, and the decrease condition decreasing the adjacent distances in the predetermined direction according to a third defined pattern.

4. The non-transitory computer-readable medium according to claim 2, wherein the condition acquiring includes acquiring the arrangement condition including a selected adjacent distance, and the data generating includes setting a distance in the predetermined direction between any selected two of the lines that are adjacent to each other, from among the plurality of lines, as the selected adjacent distance specified by the arrangement condition, and setting the adjacent distance not set as the selected adjacent distance, in accordance with the selected adjacent distance and the change condition.

5. The non-transitory computer-readable medium according to claim 1, wherein the condition acquiring includes acquiring the arrangement condition including a number of the plurality of lines aligned in the predetermined direction, the number being set based on operation of an operation portion provided in the sewing data generation device, and the data generating includes setting, inside the sewing region, the plurality of lines of the number specified by the arrangement condition.

6. The non-transitory computer-readable medium according to claim 5, wherein the computer-readable instructions further instruct the processor to perform a process comprising:

arrangement region setting of setting, inside the sewing region, an arrangement region that is the same as the sewing region or smaller than the sewing region, for arranging the plurality of lines, and the data generating includes arranging the plurality of lines inside the arrangement region.

7. The non-transitory computer-readable medium according to claim 6, wherein in a case where a new arrangement region and a new arrangement condition are acquired in a state in which the plurality of lines have been set inside the arrangement region previously set, the data generating includes:

re-setting a first portion of each one of the plurality of lines that is inside the new arrangement region in accordance with the new arrangement condition; and maintaining a second portion of each one of the plurality of lines that is outside the new arrangement region.

8. The non-transitory computer-readable medium according to claim 1, wherein the data generating includes setting certain ones of the plurality of lines in an annular shape surrounding the reference line, in accordance with the arrangement condition.

9. The non-transitory computer-readable medium according to claim 1, wherein the condition acquiring includes acquiring the arrangement condition including a selected adjacent distance decided based on operation of an operation portion provided in the sewing data generation device, and the data generating includes setting a distance in the predetermined direction between any selected two of the lines that are adjacent to each other, from among the plurality of lines, as the selected adjacent distance specified by the arrangement condition.

10. The non-transitory computer-readable medium according to claim 1, wherein the reference acquiring includes acquiring, as the reference line, a line selected from among a plurality of candidate reference lines, based on operation of an operation portion provided in the sewing data generation device.

11. A sewing machine comprising:

a needle bar configured to move up and down to form stitches in a sewing object;

a holder detachably mounting an embroidery frame, the holder being configured to move with respect to the needle bar;

a processor; and a memory storing computer-readable instructions that, when executed by the processor, instruct the processor to perform processes comprising:

reference acquiring of acquiring an embroidery pattern to be sewn that is arranged inside a sewing region, and a reference line arranged inside a sewing region, the reference line being a line surrounding and arranged entirely outside the embroidery pattern;

condition acquiring of acquiring an arrangement condition for arranging a plurality of lines inside the sewing region and outside the embroidery pattern;

data generating of generating sewing data for forming stitches along the plurality of lines, the plurality of lines being arranged inside the sewing region and outside the embroidery pattern in accordance with the arrangement condition using the reference line as a reference; and sewing of moving the needle bar and the holder in accordance with the sewing data to form stitches along the plurality of lines in the sewing object held by the embroidery frame, the plurality of lines including a first line, a second line, a third line, and a fourth line, the first line being arranged at a position spaced outside the reference line in a predetermined direction by a first distance, the second line and the third line being arranged adjacent to each other further in the predetermined direction than the first line, the second line and the third line being spaced from each other by a second distance, the fourth line being arranged at a position spaced from the third line in the predetermined direction by a third distance different from the second distance.

* * * * *